US005466172A

United States Patent [19]

Carstens et al.

[11] Patent Number: 5,466,172

[45] Date of Patent: Nov. 14, 1995

[54] INTER-MODULE SEMI-RIGID CABLE CONNECTOR AND CONFIGURATION OF MODULES EMPLOYING SAME

[75] Inventors: Robert J. Carstens, Phoenix; John E. Gatti, Scottsdale, both of Ariz.; Thomas M. Shoda, Foster City; John W. Toor, Palo Alto, both of Calif.

[73] Assignee: Motorola, Inc., Schaumburg, Ill.

[21] Appl. No.: 91,505

[22] Filed: Jul. 14, 1993

[51] Int. Cl.[6] ..... H01R 31/08

[52] U.S. Cl. ..... 439/509; 439/640; 439/502

[58] Field of Search ..... 439/445, 447, 439/502, 507, 509, 512, 513, 607, 188, 640, 209

[56] References Cited

U.S. PATENT DOCUMENTS

| | | | |
|---|---|---|---|
| 1,920,553 | 8/1933 | Fossati | 439/447 X |
| 4,082,422 | 4/1978 | Kloots | 439/447 X |
| 4,134,045 | 1/1979 | Quin | 439/502 X |
| 4,875,871 | 10/1989 | Booty, Sr. et al. | 439/209 |
| 4,941,810 | 7/1990 | Ankers et al. | 439/610 |
| 4,950,178 | 8/1990 | Harvey et al. | 439/507 |

*Primary Examiner*—David L. Pirlot

*Attorney, Agent, or Firm*—Walter W. Nielsen; S. Kevin Pickens

[57] ABSTRACT

A cable connector or jumper for providing alternating current between adjacent electrical modules comprises a first head member having a set of recessed prongs, a second head member having a set of recessed mating apertures, and a semi-rigid, tubular connecting member. The connecting member incorporates a ferrule of magnetic material for reducing RF emissions. The connecting member is sufficiently rigid to permit same to be manually grasped for insertion and removal of the head members into corresponding connectors on adjacent electrical modules, while the connecting member is sufficiently flexible to permit the head members to be moved relative to one another in order to facilitate their insertion into and removal from the module connectors.

16 Claims, 4 Drawing Sheets

INTER-MODULE SEMI-RIGID CABLE CONNECTOR AND CONFIGURATION OF MODULES EMPLOYING SAME

RELATED INVENTIONS

The present invention is related to the following inventions which are assigned to the same assignee as the present invention:

(1) "Stackable Module System" having Ser. No. 08/094, 652 filed on Jul. 19, 1993;

(2) "Stackable Computer System" (design) having Ser. No. 29/010,445, filed on Jul. 7, 1993; and (3) "AC Power Connector" (design) having Ser. No. 29/010,440, filed on Jul. 7, 1993.

The subject matter of the above-identified related inventions is hereby incorporated by reference into the disclosure of this invention.

TECHNICAL FIELD

This invention relates generally to the packaging of data processing systems and, in particular, to a cable connector for operatively coupling adjacent electrical or electronic modules, and to a configuration of modules employing such cable connector.

BACKGROUND OF THE INVENTION

The present invention has utility in the interconnection of modules in a data processing system. As is well known, data processing systems typically comprise a plurality of modules, such as a processing module, memory module, input/output module, power supply module, peripheral module(s), printer module, display module, and so forth. In some data processing system, some or all of the above modules may be combined in one package or "skin". However, the present invention is directed towards a problem involving a data processing system configuration (e.g. a minicomputer) comprising a plurality of adjacent, interlocking modules.

In one embodiment of such data processing system configuration, as disclosed in greater detail in Related Inventions No. 1 and 2 above, the various system modules are stackable in an interlocking manner to form an integral packaging configuration. In this manner, such modules which make up the system may be easily installed, replaced, and/or upgraded. In addition, the resulting "tower" is visually distinctive and has significant commercial appeal. However, the modules each need to receive electric power, and they may have to be operatively connected by external signal cables and the like.

In the prior art it is known to provide each module of a data processing system with its own power cord. It is also known to provide a power connector on a given module (e.g. the processor module or power supply module) into which a power cord for another module (e.g. display module) may be inserted. It is also known to operatively interconnect modules by means of lengthy signal cables.

However, these prior art arrangements for providing power and/or signals to various modules have several significant disadvantages. First, in the majority of locations where data processing systems are used—i.e., in the home, office, school, in retail sales locations, etc.—the plethora of cables and power cords used to interconnect such modules is usually very unsightly and often hazardous. Secondly, such cables and power cords often represent a significant source of radio frequency (RF) emissions and thus violate governmental standards regulating the permissible amount of such emissions. Thirdly, such cables and power cords may consume considerable space on or beneath the work surface.

Therefore, there is a significant need for a cable connector, and an associated configuration of such cable connectors and electrical or electronic modules, which avoid the disadvantages of the above-mentioned prior art.

SUMMARY OF THE INVENTION

In the present invention there is provided a cable connector for operatively coupling adjacent electrical modules, which may be, for example, stacked or horizontally configured. In a preferred embodiment, the cable connector comprises first and second head members, one having a male-type connector, the other having a female-type connector, and a semi-rigid, tubular connecting member surrounding a cable. The connecting member is sufficiently rigid to permit it to be manually grasped for insertion and removal of the head member connectors into corresponding connectors on adjacent electrical modules, while the connecting member is sufficiently flexible to permit the head members to be moved relative to one another in order to facilitate their insertion into and removal from the module connectors.

The semi-rigid, tubular connecting member has a rigid portion, which includes a ferrule or cylindrical member of magnetic material such as iron, which surrounds a portion of the cable and serves as a shield against RF emissions emanating from the cable. The connecting member also has at least one flexible portion, which in a preferred embodiment comprises a plurality of spaced, planar members which are affixed perpendicularly to the cable and which permit the cable to be flexed. The length of the cable connector substantially matches the distance between the connectors on adjoining modules to which it is intended to be connected, thus minimizing the cost of its manufacture and optimizing its visual appearance.

Because the cable connector is moderately flexible, it may be easily attached and detached from the corresponding connectors on the modules to which it is coupled. As mentioned above, such flexibility enables the cable connector head members to be moved relative to one another in order to facilitate their insertion into and removal from the module connectors. In addition, the longitudinal flexibility of the cable connector permits it to accommodate a wider tolerance in distances between connectors on adjoining modules. Moreover, such flexibility prevents snapping or breaking of the cable connector should one module be inadvertently moved relative to another.

On the other hand, the cable connector is sufficiently rigid to permit the tubular connecting member to be manually grasped to permit it to be removed from the module connectors.

The above-mentioned structure contrasts dramatically with that of known inter-module cables and cords in that the present invention significantly reduces the visual unsightliness, hazard potential, and "footprint" of known inter-module cable connectors.

Thus it is an advantage of the present invention to provide a cable connector or jumper which has just sufficient length to interconnect adjacent modules.

It is another advantage of the present invention to provide a cable connector which comprises an integral RF shield in the form of a ferrule of magnetic material.

It is yet another advantage of the present invention to provide a cable connector which has a rigid portion and a flexible portion, the rigid portion of the cable connector being sufficient to permit it to be readily removed from the module connectors and the flexible portion of the cable connector being sufficient to permit it to be easily affixed to the module connectors.

According to one aspect of the invention, there is provided a cable connector for operatively coupling adjacent electrical modules comprising a first head member having a first set of contacts; a second head member having a second set of contacts; and a semi-rigid member for physically connecting the first and second head members.

In a more comprehensive embodiment of the invention there is provided a configuration of electrical modules comprising a first electrical module comprising a first connector having a first set of contacts; a second electrical module comprising a second connector having a second set of contacts; a cable connector for operatively coupling the electrical modules comprising a first head member having a third set of contacts for connecting to the first set of contacts on the first electrical module; a second head member having a fourth set of contacts for connecting to the second set of contacts on the second electrical module; and a semi-rigid member for physically connecting the first and second head members.

BRIEF DESCRIPTION OF THE DRAWINGS

The invention is pointed out with particularity in the appended claims. However, other features of the invention will become more apparent and the invention will be best understood by referring to the following detailed description in conjunction with the accompanying drawings in which:

DETAILED DESCRIPTION OF A PREFERRED EMBODIMENT

Figure 1:
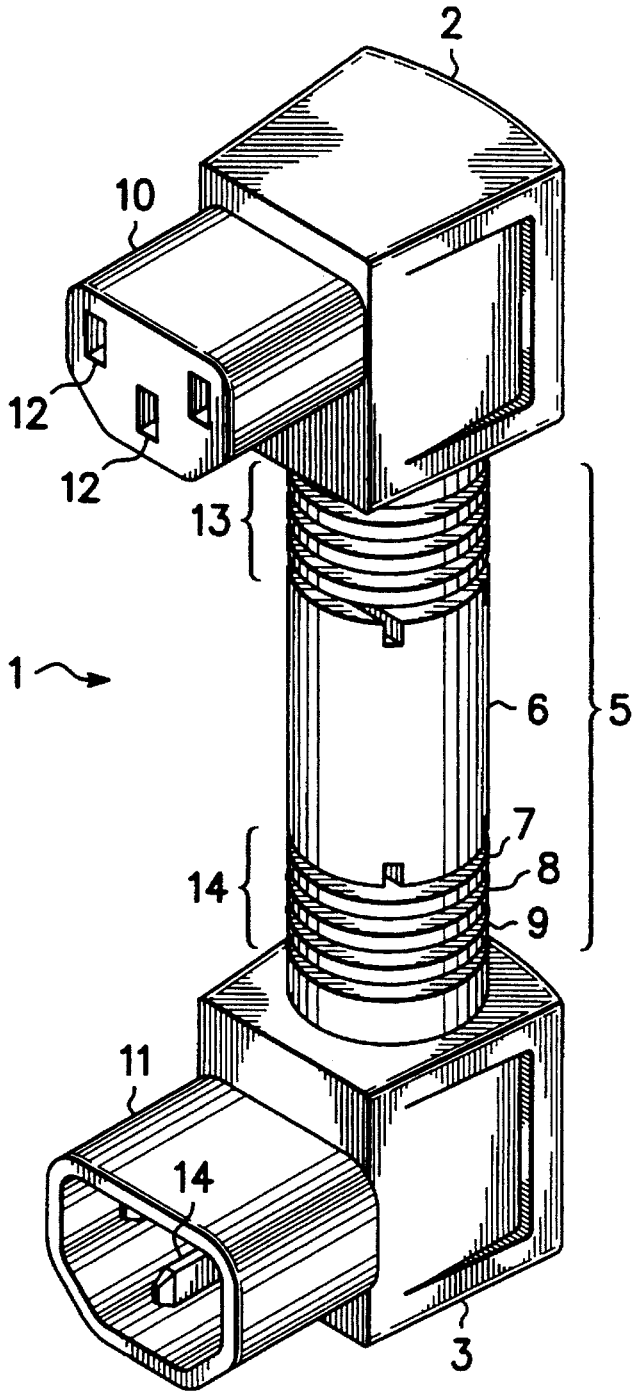
FIG. 1 shows a perspective view of an inter-module semi-rigid cable connector in accordance with a preferred embodiment of the invention.

FIG. 1 shows a perspective view of an inter-module semi-rigid cable connector 1 in accordance with a preferred embodiment of the invention. The cable connector 1 comprises a first head member 2, a second head member 3, and a semi-rigid member 5 for physically connecting the first and second head members 2,3.

The first head member 2 comprises a first set of contacts in the form of recessed, electrically conductive apertures 12. The first set of contacts may be provided in the form of a commercially available connector 10 which is suitably affixed to head member 2.

The second head member 3 comprises a second set of contacts in the form of recessed, electrically conductive prongs 14. The second set of contacts may be provided in the form of a commercially available connector 11 which is suitably affixed to head member 3.

The semi-rigid member 5 comprises means, such as an internal multi-conductor cable (not shown) for functionally coupling respective ones of the first and second sets of contacts 12,14. In a preferred embodiment, the cable is electrically conductive and is rated for carrying alternating electrical current in the range of 115–230 volts, 50–60 Hertz, not exceeding 13 amperes.

The semi-rigid member 5, in addition to carrying an internal cable (not shown), also comprises a rigid member 6. Rigid member 6 is affixed to a first longitudinal section of the cable. In a preferred embodiment, rigid member 6 is affixed to and surrounds a central portion of the cable, and it comprises a ferrule or cylindrical member of magnetic material such as iron, which encircles the conductive cable, thereby inhibiting RF emissions from such cable.

The semi-rigid member 5 also comprises at least one flexible member 14 comprising a plurality of spaced, planar members 7–9 affixed to at least a second longitudinal section of the cable. In a preferred embodiment, planar members 7–9 are disk-shaped, and a suitable number of them are perpendicularly affixed to the cable on either side of central, rigid member 6.

In a preferred embodiment the head members 2,3 and semi-rigid member 5 are substantially formed of a suitable injection molding material such as polyvinyl chloride.

When manually grasped and twisted, the semi-rigid member 5 of the cable connector 1 is substantially rigid along the region of the rigid member 6 and is moderately flexible, both to axial bending and to rotational twisting, in the regions of the flexible members 13,14.

Figure 2:
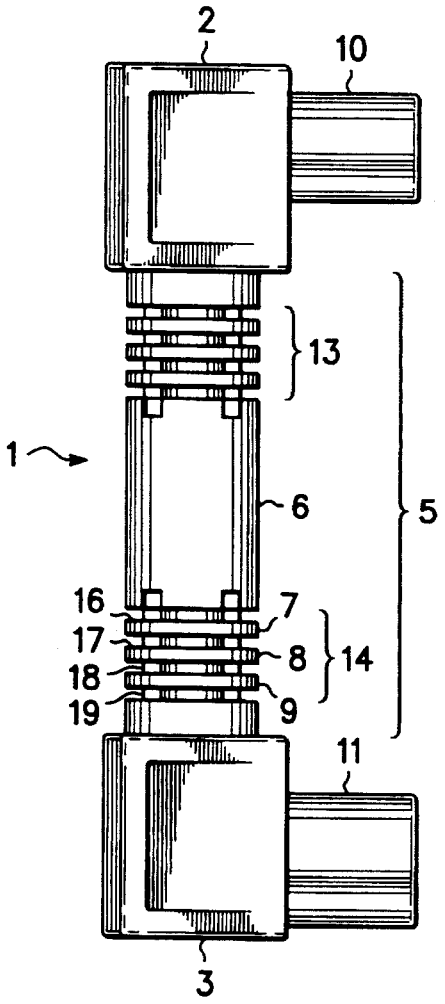
FIG. 2 shows a side view of an inter-module semi-rigid cable connector in accordance with a preferred embodiment of the invention.

FIG. 2 shows a side view of an inter-module semi-rigid cable connector 1 in accordance with a preferred embodiment of the invention. From FIG. 2 one may view the spaces between adjacent planar members 7–9, such as spaces 16,17. One may also view small rib-like members 18,19 which extend outwardly from the cable, in the same plane as the drawing, and are affixed to their adjacent planar members. Rib-like members 18,19 provide a slight stiffening of the semi-rigid member 5 with respect to axial bending in either direction parallel to the plane of the drawing.

Figure 3:
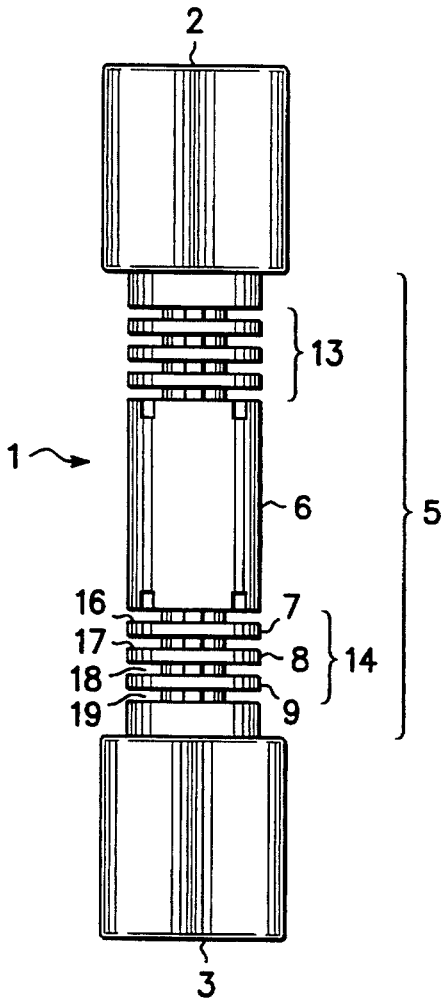
FIG. 3 shows a back view of an inter-module semi-rigid cable connector in accordance with a preferred embodiment of the invention.

FIG. 3 shows a back view of an inter-module semi-rigid cable connector 1 in accordance with a preferred embodiment of the invention. In FIG. 3 the rib-like members 18,19 are viewed perpendicular to the plane of the drawing, and they provide stiffening of the semi-rigid member 5 with respect to axial bending in either direction perpendicular to the plane of the drawing.

Figure 4:
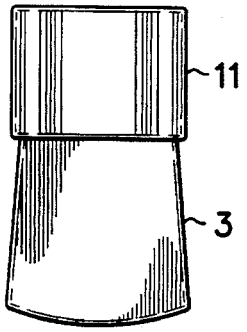
FIG. 4 shows a bottom view of an inter-module semi-rigid cable connector in accordance with a preferred embodiment of the invention.

FIG. 4 shows a bottom view of an inter-module semi-rigid cable connector in accordance with a preferred embodiment of the invention. Visible in FIG. 4 are the bottom of the second head member 3 and the connector 11 which houses the second set of contacts (not shown).

Figure 5:
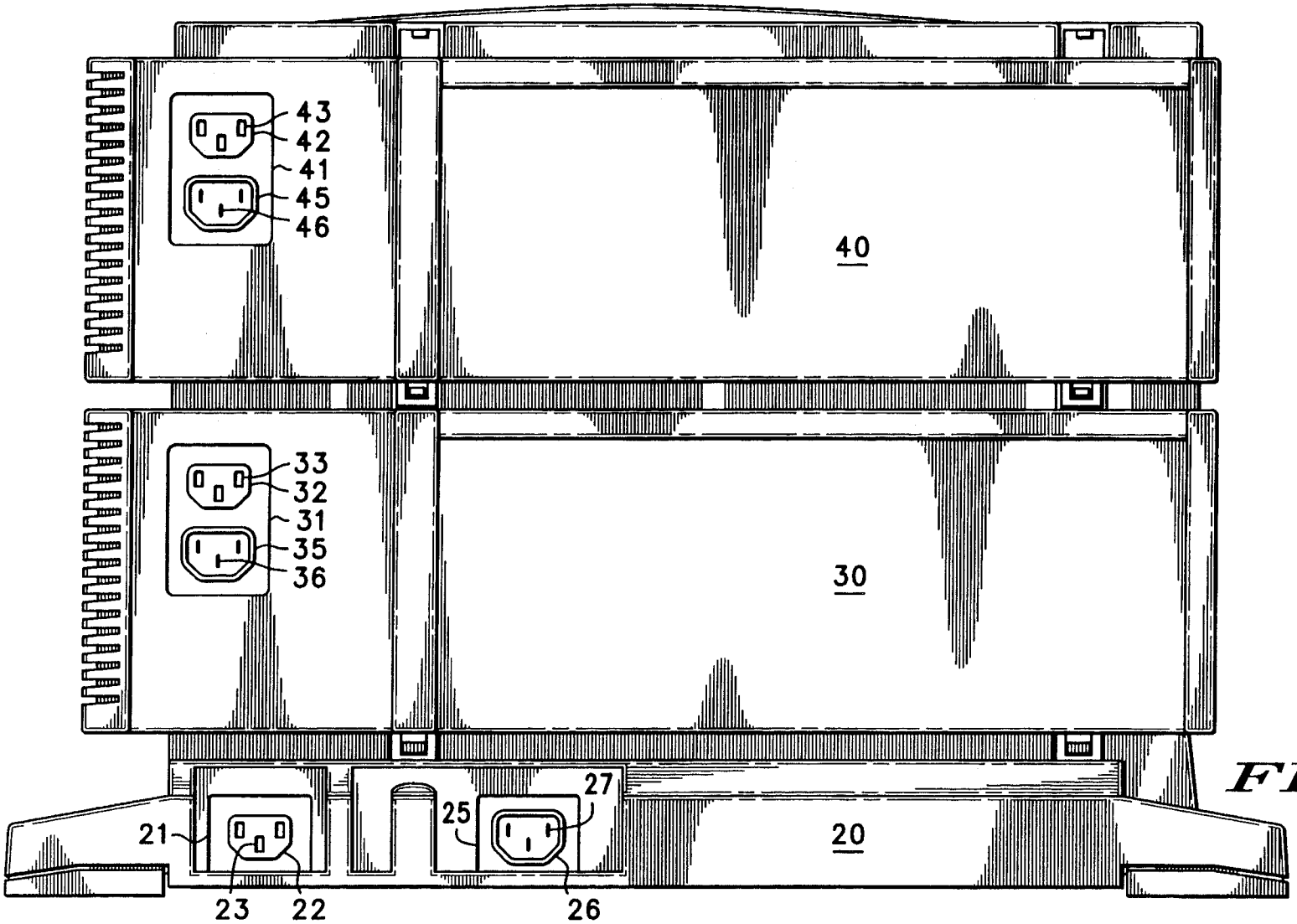
FIG. 5 shows a back view of a configuration of modules prior to incorporating an inter-module semi-rigid cable connector in accordance with a preferred embodiment of the invention.

FIG. 5 shows a back view of a configuration of modules prior to incorporating an inter-module semi-rigid cable connector in accordance with a preferred embodiment of the invention. As disclosed in greater detail in Related Invention No. 1, the various modules which may comprise a particular data processing system configuration include a base module 20, as well as modules 30 and 40.

Base module 20 comprises a connector 22 within cut-out

21. Connector 22 comprises a set of contacts such as recessed, electrically conductive apertures 23. Base module 20 also comprises a connector 26 within cut-out 25. Connector 26 comprises a set of contacts such as recessed, electrically conductive prongs 27. An electrical power supply cord (shown in FIG. 6) may be connected to connector 26.

Module 30 comprises a connector 32 within cut-out 31. Connector 32 comprises a set of contacts such as recessed, electrically conductive apertures 33. Module 30 also comprises a connector 35 within cut-out 31. Connector 35 comprises a set of contacts such as recessed, electrically conductive prongs 36.

Similarly, module 40 comprises a connector 42 within cut-out 41. Connector 42 comprises a set of contacts such as recessed, electrically conductive apertures 43. Module 40 also comprises a connector 45 within cut-out 41. Connector 45 comprises a set of contacts such as recessed, electrically conductive prongs 46.

Figure 6:
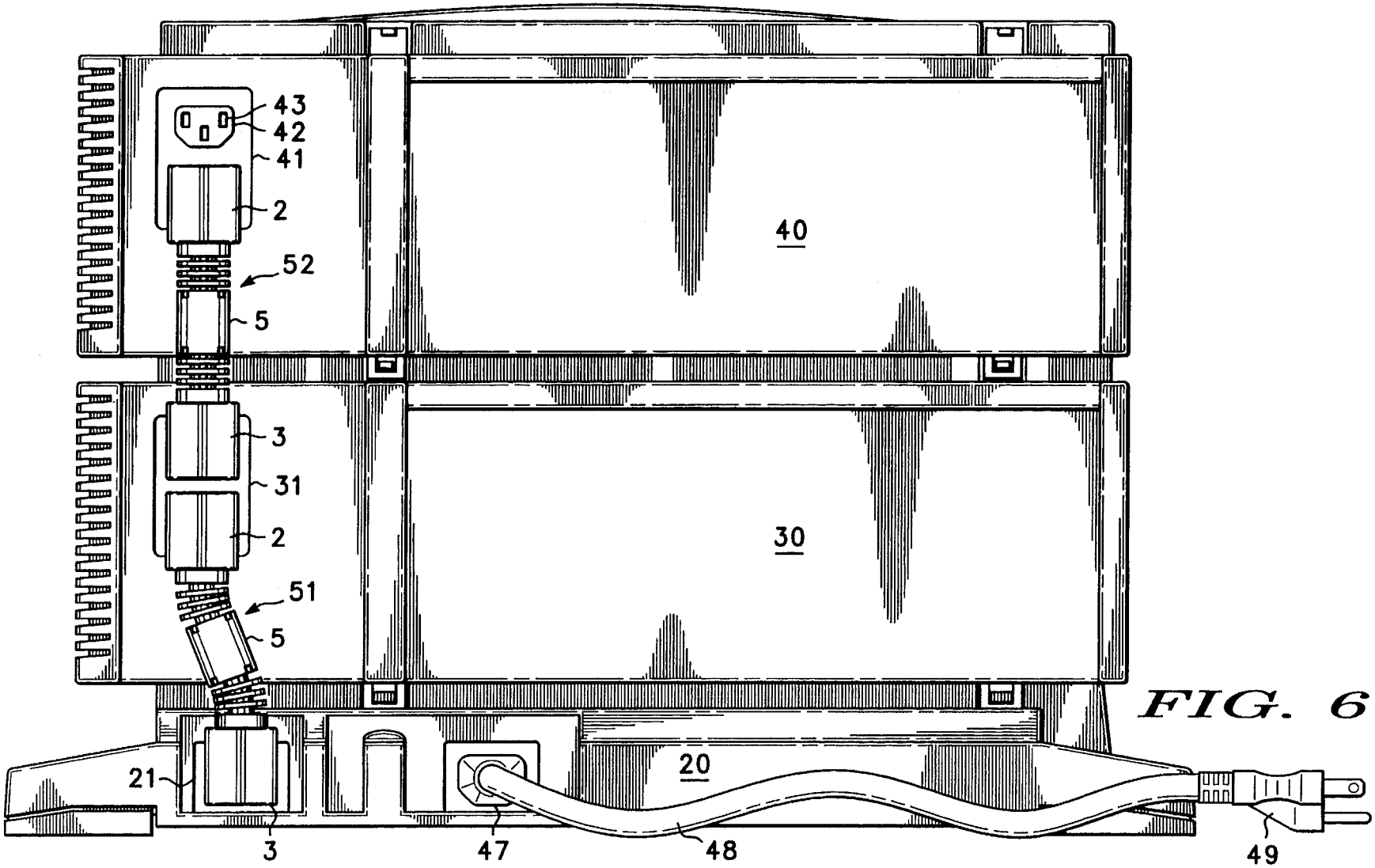
FIG. 6 shows a back view of a configuration of modules incorporating an inter-module semi-rigid cable connector in accordance with a preferred embodiment of the invention.

FIG. 6 shows a back view of a configuration of modules incorporating an inter-module semi-rigid cable connector in accordance with a preferred embodiment of the invention. As will be seen from FIG. 6, a first cable connector 51 operatively couples the adjacent electrical modules 20 and 30, while a second cable connector 52 operatively couples the adjacent electrical modules 30 and 40. A first head member 2 of cable connector 51 is coupled to the set of contacts 36 (FIG. 5) of connector 35 of module 30, and a second head member 3 of cable connector 51 is coupled to the set of contacts 23 (FIG. 5) of connector 22 of base module 20.

Likewise, a first head member 2 of cable connector 52 is coupled to the set of contacts 46 (FIG. 5) of connector 45 of module 40, and a second head member 3 of cable connector 52 is coupled to the set of contacts 33 (FIG. 5) of connector 32 of module 30.

A connector 47 of electrical power cord 48 is connected to contacts 27 (FIG. 5) of connector 26 of base module 20.

It will be appreciated that the present invention therefore provides a significantly improved cable connector and a correspondingly improved configuration of electrical modules incorporating such cable connector. The invention offers a combination of advantages, including greater visual appeal, improved safety, reduction of RF emissions, and improved space savings, over known cable connectors and multi-module data processing systems.

Furthermore, it will be apparent to those skilled in the art that the disclosed invention may be modified in numerous ways and may assume many embodiments other than the preferred form specifically set out and described above. The cable connector should not be considered as necessarily limited to a power cable, as the inventive concept may be readily extended to control and signal cables interconnecting related modules. In addition, the cables need not be restricted to electrically conductive cables. For example, the cable may be a fiber optic cable, and the various connector contacts on the modules and cable may be suitable fiber optic couplers.

Accordingly, it is intended by the appended claims to cover all modifications of the invention which fall within the true spirit and scope of the invention.

What is claimed is:

1. A cable connector for operatively coupling adjacent electrical modules comprising:

a first head member having a first set of contacts;

a second head member having a second set of contacts; and a semi-rigid member for physically connecting said first and second head members and comprising a cable;

a rigid member affixed to a first longitudinal section of said cable; and a flexible member affixed to a second longitudinal section of said cable.

2. The cable connector recited in claim 1, wherein said rigid member comprises a ferrule of magnetic material.

3. The cable connector recited in claim 1, wherein said flexible member comprises a plurality of spaced, planar members affixed perpendicularly to said cable.

4. The cable connector recited in claim 1, wherein said flexible member is formed of polyvinyl chloride.

5. A cable connector for providing alternating current between adjacent electrical modules comprising:

a first head member having a set of electrically conductive prongs;

a second head member having a set of electrically conductive apertures; and a semi-rigid member for physically connecting said first and second head members, the semi-rigid member comprising a cable;

a rigid member affixed to a first longitudinal section of said cable; and a flexible member affixed to a second longitudinal section of said cable.

6. The cable connector recited in claim 5, wherein said rigid member comprises a ferrule of magnetic material.

7. The cable connector recited in claim 5, wherein said flexible member comprises a plurality of spaced, planar members affixed perpendicularly to said cable.

8. The cable connector recited in claim 5, wherein said flexible member is formed of polyvinyl chloride.

9. A configuration of electrical modules comprising:

a first electrical module comprising a first connector having a first set of contacts;

a second electrical module comprising a second connector having a second set of contacts;

a cable connector for operatively coupling said electrical modules comprising:

a first head member having a third set of contacts for connecting to said first set of contacts on said first electrical module;

a second head member having a fourth set of contacts for connecting to said second set of contacts on said second electrical module; and a semi-rigid member for physically connecting said first and second head members and comprising a cable;

a rigid member affixed to a first longitudinal section of said cable; and a flexible member affixed to a second longitudinal section of said cable.

10. The configuration of electrical modules recited in claim 9, wherein said rigid member comprises a ferrule of magnetic material.

11. The configuration of electrical modules recited in claim 9, wherein said flexible member comprises a plurality of spaced, planar members affixed perpendicularly to said cable.

12. The configuration of electrical modules recited in claim 9, wherein said flexible member is formed of polyvinyl chloride.

13. A configuration of electrical modules comprising:

a first electrical module comprising a first set of connectors having first and second sets of contacts;

a second electrical module comprising a second set of connectors having third and fourth sets of contacts;

a cable connector for operatively coupling said electrical modules comprising:

a first head member having a fifth set of contacts for connecting to said first set of contacts on said first electrical module;

a second head member having a sixth set of contacts for connecting to said third set of contacts on said second electrical module; and a semi-rigid member for physically connecting said first and second head members and comprising a cable;

a rigid member affixed to a first longitudinal section of said cable; and a flexible member affixed to a second longitudinal section of said cable.

14. The configuration of electrical modules recited in claim 13, wherein said rigid member comprises a ferrule of magnetic material.

15. The configuration of electrical modules recited in claim 13, wherein said flexible member comprises a plurality of spaced, planar members affixed perpendicularly to said cable.

16. The configuration of electrical modules recited in claim 13, wherein said flexible member is formed of polyvinyl chloride.

* * * * *